US006340659B1

(12) United States Patent
Kocsis et al.

(10) Patent No.: US 6,340,659 B1
(45) **Date of Patent: *Jan. 22, 2002**

(54) METAL SALTS OF LACTONES AS LUBRICANT ADDITIVES

(75) Inventors: Jody A. Kocsis, Chagrin Falls; Sheri L. Blystone; Ewa A. Bardasz, both of Mentor; Marvin B. DeTar, Wickliffe, all of OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/572,281

(22) Filed: Dec. 13, 1995

(51) Int. Cl.[7] ..... C10M 129/54
(52) U.S. Cl. ..... 508/518; 508/516
(58) Field of Search ..... 252/35, 38; 508/518, 508/516

(56) References Cited

U.S. PATENT DOCUMENTS

| | | | | |
|---|---|---|---|---|
| 2,320,241 | A | 5/1943 | Jenkins | 252/32 |
| 2,862,956 | A | 12/1958 | Gündel et al. | 260/470 |
| 2,933,520 | A | 4/1960 | Bader | 260/473 |
| 3,038,935 | A | 6/1962 | Gerber et al. | 260/520 |
| 3,471,537 | A | 10/1969 | Berke et al. | 260/429 |
| 3,557,057 | A | 1/1971 | Kaplan | 260/45.95 |
| 3,862,133 | A | 1/1975 | Layer | 260/343.3 |
| 3,954,808 | A | 5/1976 | Elliott et al. | 260/343.2 R |
| 4,013,690 | A | 3/1977 | Closse et al. | 260/343.3 |
| 4,384,138 | A | 5/1983 | Karll et al. | 562/478 |
| 4,627,928 | A | 12/1986 | Karn | 252/33 |
| 5,064,545 | A | 11/1991 | Steckel | 252/32.7 HC |
| 5,175,312 | A | 12/1992 | Dubs et al. | 549/307 |
| 5,281,346 | A | 1/1994 | Adams | 252/38 |
| 5,356,546 | A | 10/1994 | Blystone et al. | 252/35 |
| 5,441,653 | A | 8/1995 | Cleveland et al. | 252/34 |
| 5,458,794 | A * | 10/1995 | Bardasz et al. | 252/56 R |

FOREIGN PATENT DOCUMENTS

| | | |
|---|---|---|
| EP | 294 994 A | 12/1988 |
| EP | 610045 | 8/1994 |
| EP | 646638 | 4/1995 |
| EP | 657 523 A | 6/1995 |
| GB | 681091 | 10/1952 |
| WO | 9113133 | 9/1991 |

OTHER PUBLICATIONS

"The Lubrication of Gas Engines", in Gas Engines and Co–Generation: Papers presented at a Seminar Organized by the Combustion Engines Gorup of the Institution of Mechanical Engineers , held at The National Motor Museum, Solihull, West Midlands, May 10–11, 1990 by R.J. Gilbert and Wooton, D.B., Papers.

* cited by examiner

*Primary Examiner*—Ellen M. McAvoy
(74) *Attorney, Agent, or Firm*—David M. Shold; Michael F. Esposito

(57) ABSTRACT

Lubricants which comprise, as an additive a salt of the reaction product of (i) glyoxylic acid or a hydrocarbyl substituted glyoxylic acid and (ii) a hydroxyaromatic compound, at least a portion of the molecules of which are alkyl-substituted, are useful for lubricating ceramic-containing engines, high temperature engines, and natural gas-fueled engines. Particularly useful additives are those in which the hydroxyaromatic compound is a dialkyl phenol containing a t-butyl group in an ortho position.

2 Claims, No Drawings

METAL SALTS OF LACTONES AS LUBRICANT ADDITIVES

BACKGROUND OF THE INVENTION

The present invention relates to lubricants particularly for high temperature engines, ceramic engines, or natural gas engines, where the lubricant includes a salt of certain adducts of glyoxylic acids and phenols.

Adducts of glyoxylic acids and phenols are known. For example, U.S. Pat. No. 5,281,346, Adams, Jan. 25, 1994, discloses a two-cycle engine lubricant comprising alkali or alkaline earth metal salts of carboxylic aromatic acids having a formula (II)

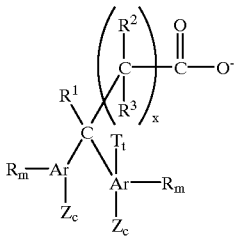

wherein T is selected from the group consisting of

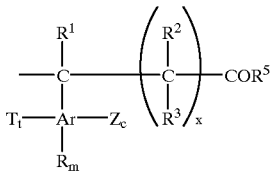

or

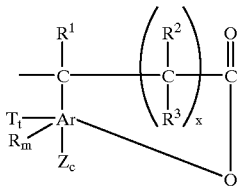

U.S. Pat. No. 5,356,546, Blystone et al, Oct. 18, 1994, discloses metal salts similar to those of U.S. Pat. No. 5,281,346. The salts find utility in lubricants and fuels other than 2-cycle engine lubricants and fuels.

U.S. Pat. No. 5,175,312, Dubs et al., Dec. 29, 1992, discloses 3-phenylbenzofuran-2-ones which are suitable for stabilizing organic material against oxidative, thermal, and actinic degradation. The materials are of the structure

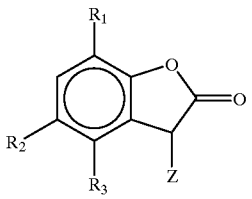

The R groups can be, among other things, alkyl groups. Z can be substituted phenyl.

U.S. Pat. No. 3,862,133, Layer, Jan. 21, 1975, discloses y lactones of o-hydroxyphenylacetic acids, prepared by reacting a hydroxybenzene compound and glyoxal using an acidic catalyst. R substituents on the hydroxybenzene can include alkyl. The products may be used to prepare new rubbers and plastics by ring opening polymerization. 4,7-di-t-butyl-5-hydroxybenzofuran-2(3H)-one has antioxidant activity and acts as a stabilizer.

U.S. Pat. No. 3,038,935 to Gerber et al. teaches the preparation of compounds of the formula

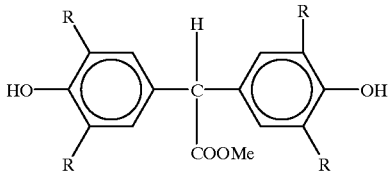

wherein each R is an aliphatic, cycloaliphatic or aromatic radical, Me is Na, K or Li, by reacting alkali metal salts of hindered phenols with dichloroacetic acid. Products are said to be useful for production of rubber auxiliaries, mineral oil additives and stabilizers for plastics.

U.S. Pat. No. 2,320,241, Jenkins, May 25, 1943, discloses a lubricating oil composition which includes lactone forming acids of the type represented by

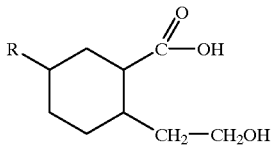

SUMMARY OF THE INVENTION

The present invention provides a process for lubricating an engine which contains at least one ceramic part which requires lubrication, comprising supplying to said part a lubricant composition comprising (a) a major amount of an oil of lubricating viscosity, and (b) a minor amount of a salt of the reaction product of (i) an aliphatic carbonyl carboxylic compound and (ii) a hydroxyaromatic compound, at least a portion of the molecules of which are alkyl-substituted.

The present invention also provides a process for lubricating an internal combustion engine which operates at a temperature of at least 250° C. at the top ring reversal position, or for lubricating a natural gas powered internal combustion engine, comprising supplying to said engine the above-described lubricant.

The invention further provides a composition of matter comprising a salt of the reaction product of (i) an aliphatic carbonyl carboxylic compound and (ii) a hydroxyaromatic compound containing at least two hydrocarbyl substituents each having at least 4 carbon atoms, at least a portion of the molecules of which are substituted with an alkyl group of at least 8 carbon atoms, said hydroxyaromatic compound further containing a tertiary alkyl group in a position ortho to the hydroxy group.

DETAILED DESCRIPTION OF THE INVENTION

The present invention relates to lubricants and lubricant additives specially designed for use with certain demanding engines, including high temperature engines, ceramic engines, and natural-gas fueled engines. A key to the lubrication of such engines is supplying a lubricant containing additives which exhibit good performance at high temperatures. The additives of the present invention comprise (a) a major amount of an oil of lubricating viscosity, and (b) a minor amount of a salt of the reaction product of (i) an aliphatic carbonyl carboxylic compound and (ii) a hydroxyaromatic compound, at least a portion of the molecules of which are alkyl-substituted.

The oil of lubricating viscosity can include natural and synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicon-based oils and mixtures thereof.

Specific examples of oils of lubricating viscosity are described in U.S. Pat. No. 4,326,972. A basic, brief description of lubricant base oils appears in an article by D. V. Brock, "Lubricant Base Oils", *Lubrication Engineering*, volume 43, pages 184–185, March, 1987.

In a preferred embodiment the oil of lubricating viscosity is an ester. A variety of ester lubricants are known and have been employed for their superior thermal stability properties. The ester lubricant of the present invention preferably contains at least one carboxylic ester of a monocarboxylic acylating agent, preferably having 4 to 15 carbon atoms, or alternatively a combination of a dicarboxylic acylating agent and a monocarboxylic acylating agent, again preferably having 4 to 15 carbon atoms, with a polyhydroxy compound containing at least two hydroxyl groups. The ester is characterized by the general formula $$[R^1COO]_nR$$

In the above formula, R is a hydrocarbyl group, each $R^1$ is independently hydrogen, a straight chain hydrocarbyl group, a branched chain hydrocarbyl group, each preferably containing from 3 to 14 carbon atoms, or a carboxylic acid- or carboxylic ester-containing hydrocarbyl group, and n is at least 2.

The carboxylic ester lubricants utilized in the present invention are thus the reaction products of one or more carboxylic acylating agents, e.g. acids, anhydrides, acid chloride, or lower esters such as methyl or ethyl, with polyhydroxy compounds containing at least two hydroxyl groups. The polyhydroxy compounds may be represented by the general formula $$R(OH)_n$$

wherein R is a hydrocarbyl group and n is at least 2. The hydrocarbyl group will preferably contain 4 to 20 or more carbon atoms, and the hydrocarbyl group may also contain one or more nitrogen and/or oxygen atoms. The polyhydroxy compounds generally will contain from 2 to 10 hydroxyl groups and more preferably from 3 to 10 hydroxyl groups.

The polyhydroxy compound may contain one or more oxyalkylene groups, and, thus, the polyhydroxy compounds include compounds such as polyetherpolyols. The number of carbon atoms and number of hydroxyl groups contained in the polyhydroxy compound used to form the carboxylic esters may vary over a wide range.

The polyhydroxy compounds used in the preparation of the carboxylic esters may also contain one or more nitrogen atoms. For example, the polyhydroxy compound may be an alkanolamine containing from 3 to 6 hydroxyl groups. In one preferred embodiment, the polyhydroxy compound is an alkanolamine containing at least two hydroxyl groups and more preferably at least three hydroxyl groups.

Specific examples of polyhydroxy compounds useful in the present invention include ethylene glycol, diethylene glycol, triethylene glycol, propylene glycol, dipropylene glycol, glycerol, neopentyl glycol, 1,2-, 1,3- and 1,4-butanediols, glycerol, pentaerythritol, dipentaerythritol, tripentaerythritol, triglycerol, trimethylolpropane, di-trimethylolpropane, sorbitol, inositol, hexaglycerol, decaglycerol, 2,2,4-trimethyl-1,3-pentanediol, etc. Preferably, the mixtures of any of the above polyhydroxy compounds can be utilized.

The carboxylic acylating agents utilized in the preparation of the carboxylic esters useful in the liquid compositions can be characterized by the following general formula $$R^1COOH$$

wherein $R^1$ is hydrogen, a hydrocarbyl group (including alkyl, aryl, and alkaryl hydrocarbyl groups), preferably of 3 to 14 carbon atoms, or a carboxylic acid- or carboxylic acid ester-containing hydrocarbyl group. Aryl groups include groups containing one or more aromatic nuclei such as benzene nuclei, naphthalene nuclei, and the like, as well as substituted aryl groups. Alkaryl groups include alkyl-substituted aryl groups such as methylphenyl and aryl substituted alkyl groups such as phenylmethyl, phenylethyl, and so on. Preferably, at least one $R^1$ group in the ester product should contain a straight chain hydrocarbyl group or a branched chain hydrocarbyl group. In one preferred embodiment, the branched chain hydrocarbon group contains from 5 to 20 carbon atoms and in a more preferred embodiment, contains from 5 to 14 carbon atoms.

In one embodiment, the branched chain hydrocarbyl groups are characterized by the structure $$—C(R^2)(R^3)(R^4)$$

wherein $R^2$, $R^3$ and $R^4$ are each independently alkyl groups, and at least one of the alkyl groups contains two or more carbon atoms. Such branched chain alkyl groups, when attached to a carboxyl group are referred to in the industry as neo groups and the acids are referred to a neo acid. The neo acids are characterized as having alpha-, alpha-, disubstituted hydrocarbyl groups. In one embodiment, $R^2$ and $R^3$ are methyl groups and $R^4$ is an alkyl group containing two or more carbon atoms.

Any of the above hydrocarbyl groups ($R^1$) may contain one or more carboxy groups or carboxy ester groups such as —$COOR^5$ wherein $R^5$ is a lower alkyl, hydroxyalkyl or a hydroxyalkyloxy group. Such substituted hydrocarbyl groups are present, for example, when the carboxylic acylating agent, $R^1COOH$, is a dicarboxylic acylating agent or a monoester of a dicarboxylic acylating agent. Generally, however, the acid, $R^1COOH$, is a monocarboxylic acid since polycarboxylic acids tend to form polymeric products if the reaction conditions and amounts of reactants are not carefully regulated. Mixtures of monocarboxylic acids and minor amounts of dicarboxylic acids or anhydrides are useful in preparing the esters (I).

Examples of carboxylic acylating agents containing a straight chain lower hydrocarbyl group include formic acid, acetic acid, propionic acid, butyric acid, valeric acid, hexanoic acid and heptanoic acid and anhydrides of any one thereof. Examples of carboxylic acylating agents wherein the hydrocarbyl group is a branched chain hydrocarbyl group include isobutyric acid, 2-ethyl-n-butyric acid, 2-methylbutyric acid, 2,2,4-trimethylpentanoic acid, 2-hexyldecanoic acid, isostearic acid, 2-methylhexanoic acid, 3,5,5-trimethylhexanoic acid, 2-ethylhexanoic acid, isooctanoic acid, isononanoic acid, isoheptanoic acid, isodecanoic acid, neoheptanoic acid, neodecanoic acid, and ISO Acids and NEO Acids available from Exxon Chemical Company, Houston, Texas, USA. ISO Acids are isomer mixtures of branched acids and include commercial mixtures such as ISO Heptanoic Acid, ISO Octanoic Acid, and ISO Nonanoic Acid, as well as developmental products such as ISO Decanoic Acids and ISO 810 Acid. Of the ISO Acids, ISO Octanoic acid and ISO Nonanoic acid are preferred. Neo acids include commercially available mixtures such as NEO Pentanoic Acid, NEO Heptanoic Acid, and NEO Decanoic Acid, as well as developmental products such as ECR-909 (NEO $C_9$) Acid, and ECR-903 (NEO $C_{1214}$) Acid and commercial mixtures of branched chain carboxylic acids such as the mixture identified as NEO 1214 acid from Exxon. The designation of an acid as "iso" or "neo" generally refers to the branching structure at the $\alpha$ carbon atom; the remainder of the carbon chain may or may not have further branching.

In a preferred embodiment, the ester is prepared from one of the polyhydroxy compound described above and a monocarboxylic acylating agent having from 4, 5, or 6, up to 15, 14, or 12, carbon atoms. The monocarboxylic acylating agent may be linear or branched, preferably branched. Particularly useful monocarboxylic acylating agents include branched monocarboxylic acylating agents having 8 to 10 carbon atoms.

Another third type of carboxylic acylating agent which can be utilized in the preparation of the carboxylic esters are the acids containing a straight chain hydrocarbyl group containing 8 to 22 carbon atoms. Examples of such higher molecular weight straight chain acids include decanoic acid, dodecanoic acid, stearic acid, lauric acid, behenic acid, etc.

In another embodiment, the carboxylic acylating agents utilized to prepare the carboxylic esters may comprise a mixture of a major amount of monocarboxylic acylating agents and a minor amount of dicarboxylic acylating agents. Preferably the molar amount of monocarboxylic acylating agent is at least 3 times as great as the molar amount of the dicarboxylic acylating agent. Examples of useful dicarboxylic acylating agents include maleic acid or anhydride, succinic acid or anhydride, adipic acid or anhydride, oxalic acid or anhydride, pimelic acid or anhydride, glutaric acid or anhydride, suberic acid or anhydride, azelaic acid or anhydride, sebacic acid or anhydride, etc. The presence of the dicarboxylic acylating agents results in the formation of esters of higher viscosity. The complex esters are formed by having a substantial portion of the dicarboxylic acylating agents react with more than one polyol. The reaction is generally coupling of polyols through the dicarboxylic acylating agent or anhydride. Examples of mixtures of mono- and dicarboxylic acylating agents include succinic anhydride and 3,5,5-trimethylhexanoic acid; azelaic acid and 2,2,4-trimethylpentanoic acid; adipic acid and 3,5,5-trimethylhexanoic acid; sebacic acid and isobutyric acid; adipic and a mixture of 50 parts 3,5,5-trimethylhexanoic acid and 50 parts neoheptanoic acid; and neoheptanoic acid and a mixture of 50 parts adipic acid and 50 parts sebacic acid. The use of mixtures containing larger amounts of dicarboxylic acylating agents should generally be avoided since the product ester will contain larger amounts of polymeric esters, and such mixtures may have undesirably high viscosities. Viscosity and average molecular weight of the ester can be increased by increasing the amount of dicarboxylic acid and decreasing the amount of monocarboxylic acylating agent.

For further information on various type of suitable ester lubricants and their methods of preparation, attention is directed to European Patent Publication 646 638, published Apr. 5, 1995.

The second component of the present invention is a minor amount of a salt of the reaction product of (i) glyoxylic acid or a hydrocarbyl substituted glyoxylic acid and (ii) a hydroxyaromatic compound, at least a portion of the molecules of which are alkyl-substituted. These salts, in their simplest form, can be represented by the general formula $$A^{y-}M^{y+} \quad \text{(I)}$$

wherein M represents one or more metal ions, y is the total valence of all M and A represents one or more anion containing groups having a total of about y individual anionic moieties.

These metal salts can be represented in more detail by the structure

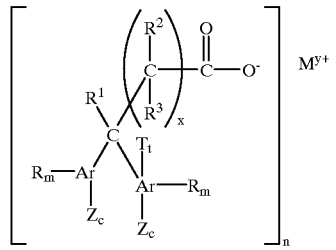

wherein M represents one or more metal ions, y is the total valence of all M, n is a number depending on the value of y, n times the number of anionic moieties in the corresponding parenthetical group is about equal to y, and the remaining elements are as defined hereinabove. Preferably Ar is a benzene nucleus, a bridged benzene nucleus or a naphthalene nucleus.

The Anion-Containing Group A

A represents one or more anion containing groups having a total of about y individual anionic moieties and each anion-containing group is generally a group of the formula (II)

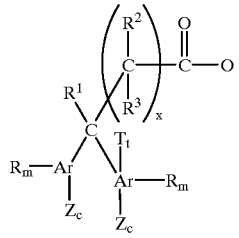

wherein T is selected from the group consisting of (V)

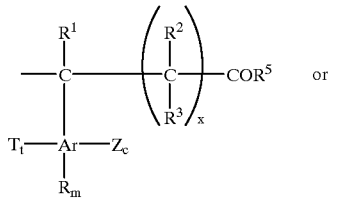

or (VI)

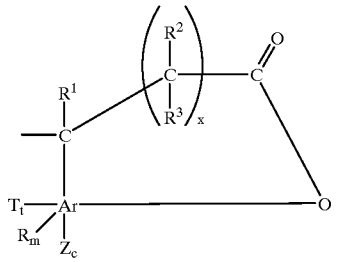

wherein each R is independently selected from $O^-$ and OR wherein $R^6$ is H or alkyl and each t is independently 0 or 1, wherein T is as hereinbefore defined and wherein each Ar is independently an aromatic group of from 4 to 30 carbon atoms having from 0 to 3 optional substituents selected from the group consisting of polyalkoxyalkyl, lower alkoxy, nitro, halo or combinations of two or more of said optional substituents, or an analog of such an aromatic nucleus, each R is independently alkyl, alkenyl or aryl containing at least 8 carbon atoms, $R^1$ is H or a hydrocarbyl group, $R^2$ and $R^3$ are each independently H or a hydrocarbyl group, each m is independently an integer ranging from I to 10, x ranges from 0 to 6, and each Z is independently OH, $(OR^4)_bOH$, or $O^-$ wherein each $R^4$ is independently a divalent hydrocarbyl group and b is a number ranging from 1 to 30 and c ranges from 0 to 3 with the proviso that when t in Formula (II)=0, or when T is Formula (V), then c is not 0, provided that the sum of m, c and t does not exceed the unsatisfied valences of the corresponding Ar.

The aromatic group Ar of formula (II) can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the Ar group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, Ar will contain only carbon atoms in the aromatic nuclei per se, although other non-aromatic substitution, such as in particular short chain alkyl substitution can also be present. Thus methyl, ethyl, propyl, and t-butyl groups, for instance, can be present on the Ar groups, even though such groups are not explicitly represented in Formula II and in other structures set forth herein.

This first reactant, being a hydroxy aromatic compound, can be referred to as a phenol. When the term "phenol" is used herein, however, it is to be understood that this term is not generally intended to limit the aromatic group of the phenol to benzene, although benzene may be the preferred aromatic group. Rather, the term is to be understood in its broader sense to include, depending on the context, for example, substituted phenols, hydroxy naphthalenes, and the like. Thus, the aromatic group of a "phenol" can be mononuclear or polynuclear, substituted, and can include other types of aromatic groups as well.

Specific examples of single ring aromatic moieties are the following:

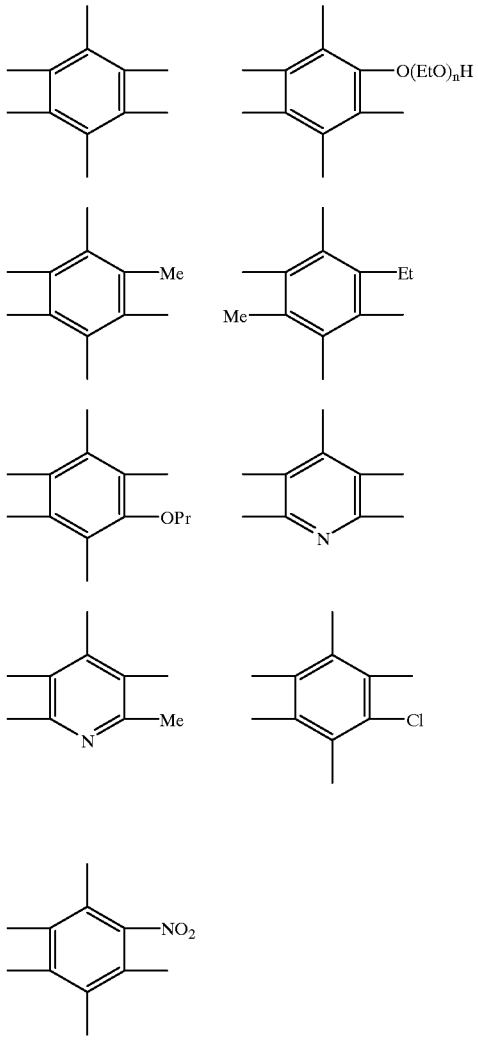

-continued

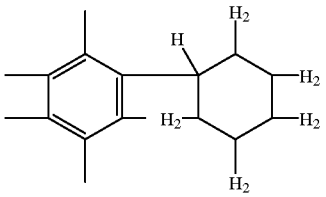

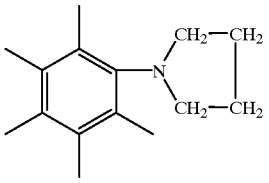

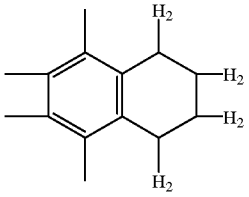

etc., wherein Me is methyl, Et is ethyl or ethylene , as appropriate, and Pr is n-propyl.

Specific examples of fused ring aromatic moieties are:

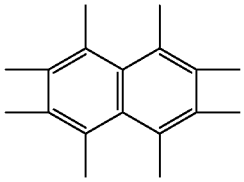

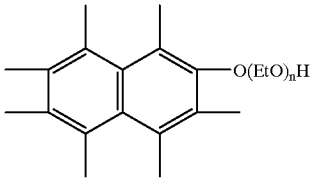

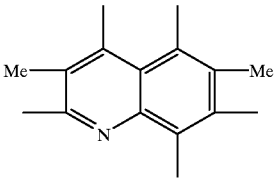

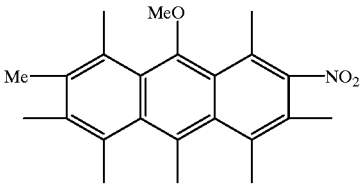

-continued

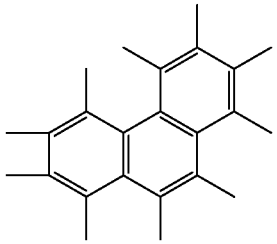

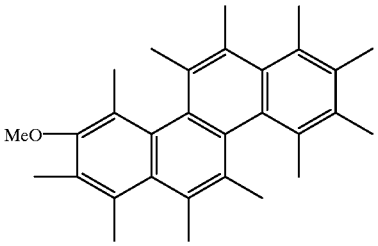

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages (e.g., $$—\overset{O}{\overset{\|}{C}}—),$$

sulfide linkages (e.g., —S—), polysulfide linkages of 2 to 6 sulfur atoms (e.g, $—S—_{2-6}$), sulfinyl linkages (e.g., —S(O)—), sulfonyl linkages $—S(O)_2—$), lower alkylene linkages (e.g., $—CH_2—$, $—CH_2—CH_2—$, $$—CH_2—\underset{\underset{R^o}{|}}{CH}—)$$

mono(lower alkyl)-methylene linkages (e.g., $—CHR^o—$), di(lower alkyl)-methylene linkages (e.g.,$—CR^o{}_2—$), lower alkylene ether linkages (e.g., $—CH_2O—$, $—CH_2O—CH_2—$, $—CH_2—CH_2O—$, $—CH_2CH_2OCH_2CH_2—$, $$—CH_2\underset{\underset{R^o}{|}}{C}HOCH_2\underset{\underset{R^o}{|}}{C}H—,\quad —CH_2\underset{\underset{R^o}{|}}{C}HO\underset{\underset{R^o}{|}}{C}HCH_2—,$$

etc.), lower alkylene sulfide linkages (e.g., wherein one or more —O—'s in the lower alkylene ether linkages is replaced with a S atom), lower alkylene polysulfide linkages (e.g., wherein one or more —O— is replaced with a $—S_{2-6}—$ group), amino linkages (e.g.,

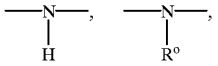

—$CH_2NCH_2$—, -alk-N—, where alk is lower alkylene, etc.), polyamino linkages (e.g., —$N(alkN)_{1-10}$, where the unsatisfied free N valences are taken up with H atoms or R° groups), linkages derived from oxo- or keto- carboxylic acids (e.g.)

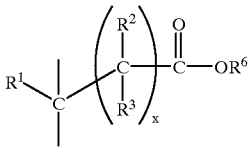

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each R° being a lower alkyl group).

Specific examples of linked moieties are:

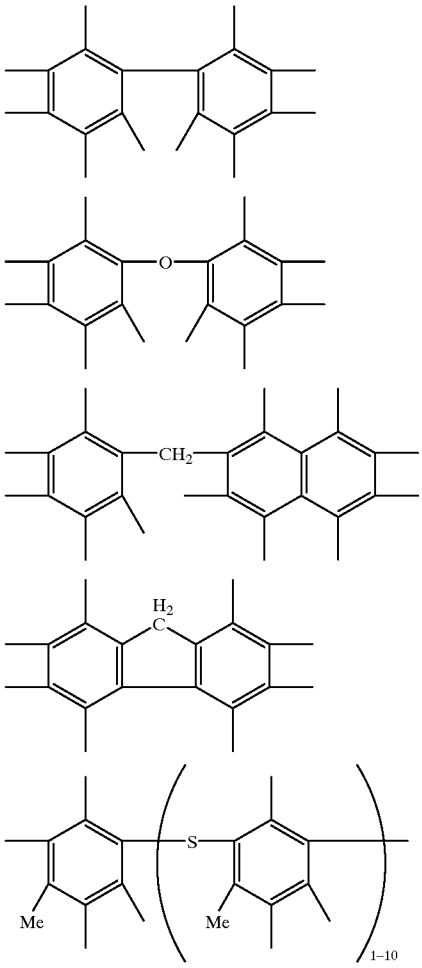

-continued

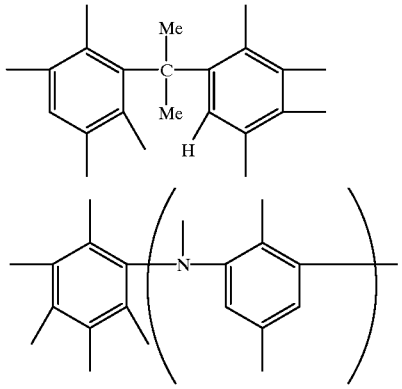

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus. Most preferably Ar is a benzene nucleus substituted by an R group in a position para to a Z group.

The Group R

The compounds of formula (I) employed in the compositions of the present invention contain, directly bonded to at least one aromatic group Ar, at least one group R which, independently, is an alkyl, alkenyl or aryl group containing at least 4, and preferably at least 8 carbon atoms, provided that the total number of carbon atoms in all such R groups is at least 12, preferably at least 16 or 24. More than one such group can be present, but usually no more than 2 or 3 are present for each aromatic nucleus in the aromatic group Ar.

The number of R groups on each Ar group is indicated by the subscript m. For the purposes of this invention, each m may be independently an integer ranging from 1 up to 10 with the proviso that m does not exceed the unsatisfied valences of the corresponding Ar. Frequently, each m is independently an integer ranging from 1 to 3. In an especially preferred embodiment each in equals 1.

Each R frequently is an aliphatic group containing at least 8 and up to 750 carbon atoms, frequently from 8 to 600 carbon atoms, preferably from 8 to 400 carbon atoms and more preferably from 8 to 200 carbons. R is preferably alkyl or alkenyl, preferably substantially saturated alkenyl. In one preferred embodiment, R contains at least 10 carbon atoms, often from 12 to 100 carbons. In another embodiment, each R contains an average of at least 30 carbon atoms, often an average of from 30 to 100 carbons. In another embodiment, R contains from 12 to 50 carbon atoms. In a further embodiment, R contains from 7 or 8 to 30 or 24 carbon atoms, preferably from 12 to 24 carbon atoms and more preferably from 12 to 18 carbon atoms. In one embodiment, at least one R is derived from an alkane derivative or alkene having number average molecular weight ranging from 150 or 300 to 800 or 400. In another embodiment, R contains an average of at least 50 carbon atoms often from 50 up to 300, preferably up to 100 carbon atoms.

When the group R is an alkyl or alkenyl group having from 8 to 28 carbon atoms, it is typically derived from the corresponding olefin; for example, a dodecyl group is derived from dodecene, an octyl group is derived from octene, etc. When R is a hydrocarbyl group having at least 30 carbon atoms, it is frequently an aliphatic group made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-mono olefins such as homopolymers of ethylene. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene. In a further preferred embodiment, R is a propylene tetramer.

As used herein, the term "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon, groups, Substantially hydrocarbon describes groups, including hydrocarbon based groups, which contain non-hydrocarbon substituents, or non-carbon atoms in a ring or chain, which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic- substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Typically, no more than 2, preferably no more than one, non-hydrocarbon substituent or non-carbon atom in a chain or ring will be present for every ten carbon atoms in the hydrocarbyl group. Usually, however, the hydrocarbyl groups are purely hydrocarbon and contain substantially no such non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present. In an especially preferred embodiment, the hydrocarbyl group R is substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

Preferably, hydrocarbyl groups R of the anion containing groups of formula (II) of this invention are substantially aliphatic in nature, that is, they contain no more than one non-aliphatic (cycloalkyl, cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. Typically, these purely aliphatic R groups are alkyl or alkenyl groups.

Specific non-limiting examples of substantially saturated hydrocarbyl R groups are: methyl, tetra (propylene), nonyl, triisobutyl, tetracontanyl, henpentacontanyl, a mixture of poly(ethylene/propylene) groups of 35 to 70 carbon atoms, a mixture of the oxidatively or mechanically degraded poly(ethylene/propylene) groups of 35 to 70 carbon atoms, a mixture of poly (propylene/l-hexene) groups of 80 to 150 carbon atoms, a mixture of poly(isobutene) groups having between 20 and 32 carbon atoms, and a mixture of poly (isobutene) groups having an average of 50 to 75 carbon atoms. A preferred source of hydrocarbyl groups R are polybutenes obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

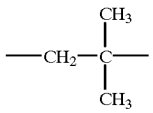

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y., and U.S. Pat. Nos. 4,379,065;

4,663,063; and 4,708,809, for relevant disclosures regarding alkylation of aromatic compounds. Other equally appropriate and convenient techniques for attaching the hydrocarbon-based group R to the aromatic moiety Ar will occur readily to those skilled in the art.

The hydrocarbyl group or groups attached to the phenolic structure preferably include alkyl groups, preferably containing 8 to 200 carbon atoms. Preferably the alkyl groups will have a number average molecular weight of 150 to 400.

When the hydroxyaromatic compound is specifically a dialkyl phenol, it is preferred that the alkyl substituents are located in the 2 and 4 positions of the phenol. If it is a tert-butyl alkyl phenol, it is preferred that a tert-butyl group is in the ortho or 2 position.

The Groups Z

Each Z is independently OH, $(OR^4)_bOH$ or $O^-$ wherein each $R^4$ is independently a divalent hydrocarbyl group and b is a number ranging from 1 to 30.

The subscript c indicates the number of Z groups that may be present as substituents on each Ar group. There will be at least one Z group substituent, and there may be more, depending on the value of the subscript m. For the purposes of this invention, c is a number ranging from 1 to 3. In a preferred embodiment, c is 1.

As will be appreciated from the foregoing, the compounds of Formula I employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH, $O^-$, or $(OR^4)_bOH$ as defined hereinabove. In a preferred embodiment, each Z is OH. In another embodiment, each Z may be $O^-$. In another preferred embodiment, at least one Z is OH and at least one Z is $O^-$. Alternatively, at least one Z may be a group of the Formula $(OR^4)_bOH$. As mentioned hereinabove, each $R^4$ is independently a divalent hydrocarbyl group. Preferably, $R^4$ is an aromatic or an aliphatic divalent hydrocarbyl group. Most preferably, $R^4$ is an alkylene group containing from 2 to 30 carbon atoms, more preferably from 2 to 8 carbon atoms and most preferably 2 or 3 carbon atoms.

The subscript b typically ranges from 1 to 30, preferably from 1 to 10, and most preferably 1 or 2 to 5.

The Groups $R^1$ $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to 100 carbon atoms, more often from 1 to 24 carbon atoms, preferably 1 to 12 and more preferably 1 to 6 carbon atoms. In a preferred embodiment, each of the aforementioned groups is independently hydrogen or alkyl or an alkenyl group. In one preferred embodiment each of $R^1$, $R^2$, and $R^2$ is, independently, H or lower alkyl. In an especially preferred embodiment, each of the aforementioned groups is H. For the purposes of this invention, the term "lower" when used to describe an alkyl or alkenyl group means from 1 to 7 carbon atoms.

The subscript x denotes the number of $—CR^2R^3—$ groups present in the anion containing group of Formula II. For the purposes of this invention, x normally ranges from 0 to 8. In a preferred embodiment, x is 0, 1 or 2. Most preferably x equals 0.

At least one linking group in the molecule will be a carboxyalkylene linking group such as a group derived from glyoxylic acid or an equivalent thereof, represented by $>C(R^1)(CR^2R^3)_xC(O)O—$ in formula (II). However, additional phenol groups can be present, linked, if desired, by other linking groups such as $—CH_2—$ (from, e.g., formaldehyde condensation) or other groups such as those —L— groups described above.

The Group T

It will be apparent that when t=1 in any of Formula II, V or VI, that groups of Formulae V or VI will be present. Termination takes place when t=0. Thus, for example, when t=1 on Formula II, a group of Formula V or VI will be present. It follows then that in order for a group of Formula V or VI to be present in the anion containing group of formula II, t in formula II equals 1.

Likewise, when t=1 in formula II, a group of formula V or VI is present. When t in either formula V or VI equals 0, no further T groups are present. However, when t in formula V or VI equals 1, one or more additional T groups are present, terminating only when finally t=0.

In one preferred embodiment, t in formula II equals zero and no groups of formula V or VI are present. In another preferred embodiment, t in formula II equals 1 and from 1 up to 3, preferably up to 2 additional groups T of formula V or VI are present.

The Metal Ions M

The symbol M in the above structural formulas represents one or more metal ions. These include alkali metal, alkaline earth metals, zinc, cadmium, lead, cobalt, nickel, iron, manganese, copper and others. Preferred are the alkali and alkaline earth metals, as well as the group 1b and 2b metals (i.e., the columns containing copper and zinc in the CAS version of the periodic table of elements). Especially preferred are sodium, potassium, calcium, magnesium, barium, and lithium. Most preferred are calcium, barium, and magnesium, particularly calcium.

The metal ions M may be derived from reactive metals or reactive metal compounds that will react with carboxylic acids or phenols to form carboxylates and phenates. The metal salts may be prepared from reactive metals such as alkali metals, alkaline earth metals, zinc, lead, cobalt, nickel, iron and the like. Examples of reactive metal compounds are sodium oxide, sodium hydroxide, sodium carbonate, sodium methylate, sodium phenoxide, corresponding potassium and lithium compounds, calcium oxide, calcium hydroxide, calcium carbonate, calcium methylate, calcium chloride, calcium phenoxide, and corresponding barium and magnesium compounds, zinc oxide, zinc hydroxide, zinc carbonate, cadmium chloride, lead oxide, lead hydroxide, lead carbonate, nickel oxide, nickel hydroxide, cobalt oxide, ferrous carbonate, ferrous oxide, cupric acetate, etc. Alternatively, reactive metal compounds can be prepared in situ by mixing, for example, an alkali metal carboxylate and a metal halide, such as cupric, zinc, or nickel chloride. Suitable metals and metal-containing reactants are disclosed in many U.S. Patents including U.S. Pat. No. 3,306,908; 3,271,310; and U.S. Reissue Patent Number 26,433.

The Total Valence y

The skilled worker will appreciate that the compounds of the general formula $$A^{y-}M^{y+} \quad (I)$$

as written, constitute a substantially neutral metal salt, although the salts of the present invention can also be overbased, as described in detail below. The metal salt is a carboxylate and/or pinnate, depending on the nature of A. Depending on the nature of the group Z in Formula (II), A may be a carboxylate, or a carboxylate-pinnate, a carboxylate-mixed pinnate/phenol, a carboxylate-alkoxylated, a carboxylate-pinnate- alkoxylated, a carboxylate-pinnate/phenol-alkoxylated, etc. The group A may also represent mixtures of two or more of these. Accordingly, it is apparent that the value of y is dependent upon the number of anion-containing moieties making up A and on the valence of the metal ion M.

The metal salts of Formula (I) may be readily prepared by reacting (a) a reactant of the formula

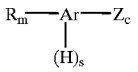

(III)

wherein R is alkyl, alkenyl or aryl containing at least 8 carbon atoms, m ranges from 1 to 10, Ar is an aromatic group containing from 4 to 30 carbon atoms having from 0 to 3 optional substituents selected as described hereinabove, or an analog of such an aromatic nucleus, wherein s is an integer of at least 1 and wherein the total of s+m does not exceed the available valences of Ar and Z is selected from the group consisting of OH or $(OR^4)_bOH$ wherein each $R^4$ is independently a divalent hydrocarbyl group and b is a number ranging from 1 to 30 and c ranges from 1 to 3, with (b) an aliphatic carbonyl carboxylic compound of the formula $$R^1CO(CR^2R^3)_xCOOR^6 \quad \text{(IV)}$$

wherein $R^1$, $R^2$ and $R^3$ are independently H or a hydrocarbyl group, $R^6$ is H or an alkyl group, and x is an integer ranging from 0 to 8 and then reacting the intermediate so formed with a metal-containing reactant to form a salt.

When x=0 in structure (IV), the material is a glyoxylic acid or a hydrocarbyl-substituted glyoxylic acid (if $R^1$=hydrocarbyl) or an ester thereof (if $R^6$=alkyl).

When $R^1$ is H, the aldehyde moiety of reactant (IV) may be hydrated. For example, glyoxylic acid is readily available commercially as the hydrate having the formula $$(HO)_2OH—COOH.$$

Thus the hydrated material is a reactive equivalent of glyoxylic acid. This and other reactive equivalents, such as acetals, half acetals, esters, and the like, are encompassed by the term "aliphatic carbonyl carboxylic compound." Such equivalents are also to be included in the more specific term "glyoxylic acid or hydrocarbyl substituted glyoxylic acid."

Water of hydration as well as any water generated by the condensation reaction is preferably removed during the course of the reaction.

Ranges of values and descriptions of the groups and subscripts appearing in the above Formulae (III) and (IV) are the same as recited hereinabove for Formulae (I) and (II). When $R^6$ is an alkyl group it is preferably a lower alkyl group, most preferably, ethyl or methyl.

The reaction is normally conducted in the presence of a strong acid catalyst, including mineral acids such as hydrochloric acid or sulfuric acid. Particularly useful catalysts are illustrated by methanesulfonic acid and paratoluene sulfonic acid. The reaction is usually conducted with the removal of water.

Reactants (a) and (b) are preferably present in a molar ratio of about 2:1. However, useful products may be obtained by employing an excess amount of either reactant. Thus, molar ratios of (a):(b) of 1:1, 1.5:1, 2:1, 1:1.5, 1:2, 3:1. etc. Are contemplated and useful products may be obtained thereby.

Illustrative examples of reactants (a) of Formula (III) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the phenolic —OH or $(OR^4)_bOH$ groups may be single ring, fused ring or linked aromatic groups as described in greater detail hereinabove.

Specific illustrative examples of compound (III) employed in the preparation of compounds of Formula (I) containing the anion containing groups A of Formula (II) include hydrocarbon substituted-phenol, naphthol, 2,2'-dihydroxybiphenyl, 4,4-dihydroxybiphenyl, 3 -hydroxy anthracene, 1,2,10- anthracene triol, resorcinol, 2-t-butyl phenol, 4-t-butyl phenol, 2,6-di-t-butyl phenol, octyl phenol, cresols, propylene tetrameter-substituted phenol, propylene oligomer (MW 300–800)-substituted phenol, polybutene ($M_n$ about 1000) substituted phenol substituted naphthols corresponding to the above exemplified phenols, methylene-bis-phenol, bis-(4-hydroxyphenyl)-2,2-propane, and hydrocarbon substituted bis-phenols wherein the hydrocarbon substituents have at least 8 carbon atoms for example, octyl, dodecyl, oleyl, poly butenyl, etc., sulfide-and polysulfide-linked analogies of any of the above, alkoxylated derivatives of any of the above hydroxy aromatic compounds, etc. Preferred compounds of Formula (III) are those that will lead to the compounds of Formula (I) having preferred anion containing groups of Formula (II).

The method of preparation of numerous alkyl phenols is well-known. Illustrative examples of alkyl phenols and related aromatic compounds and methods for preparing same are give in U.S. Pat. No. 4,740,321, to which attention is directed.

Non-limiting examples of the carboxylic reactant (b) of Formula IV include glyoxylic acid and other omega-oxo alkanoic acids, keto alkanoic acids such as pyrrhic acid, levulinic acid, ketovaleric acids, ketobutyric acids and numerous others. The skilled worker will readily recognize the appropriate compound of Formula (IV) to employ as a reactant to generate a given anion-containing group A. Preferred compounds of Formula (IV) are those that will lead to compounds of Formula (I) having preferred anion containing groups of Formula (II).

It is also contemplated that, in addition to the glyoxylic acid or substituted glyoxylic acid, a portion of one or more other carbonyl materials can also be included. Such materials include simple aldehydes and ketones, such as formaldehyde, or difunctional materials such as glyoxal. Use of such materials will be appropriate, for instance, where the relative amounts of the reactants is such that more than one aldehyde or ketone will be incorporated by condensation in the molecule, e.g., a molecule having 3 alkylphenol units and 2 aldehyde units, one of which would typically be derived from glyoxylic acid or its equivalent. Alternatively, the use of such alternative material can be desirable if at least a portion of the aromatic moieties have carboxylic acid functionality, so that the product will in any event contain an acid group. This embodiment is described in greater detail below. However, it is preferred that such materials be present in small or negligible amounts which permit the reaction to form predominantly or exclusively the materials illustrated in formulas shown here-inabove.

Thus the salt of a preferred embodiment of the reaction product can be represented by at least one of the structures

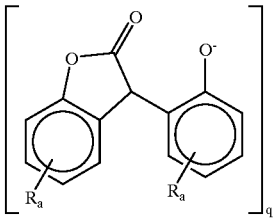

or

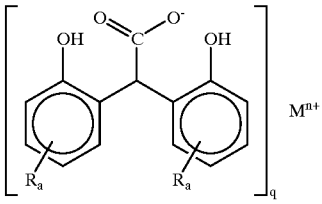

wherein $M^{n+}$is a metal ion having a charge n, q is a number from 1 to n, the valence of said metal ion being wholly or partially satisfied by the indicated anion, each a, representing the number of R substituents, is a number from 0 to 4, preferably 1 or 2, and each R is an alkyl group. At least one ring in the structure is substituted by an alkyl group, and the total number of carbon atoms in all such R groups is at least 12.

In a more preferred embodiment, the anion described in detail above is represented by the structure

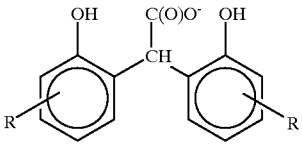

or, even more specifically,

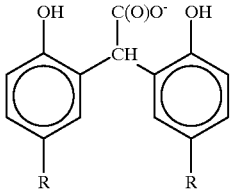

In a preferred embodiment each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent as described above.

In another preferred embodiment, the anion $A^-$ has t-alkyl substitution, such as t-butyl substitution. Such materials are preferably derived from the condensation of glyoxylic acid or an equivalent thereof with a hydroxyaromatic compound having both the R hydrocarbyl substitution described above as well as additional t-alkyl substitution. The t-alkyl substitution is preferably in one, and more preferably only one, position ortho to the hydroxy group. At least one position will remain unsubstituted and available for condensation reaction with the glyoxylic acid. Preferably the unsubstituted position is likewise ortho to the hydroxy group. In this embodiment, the salt can be represented by at least one of the structures

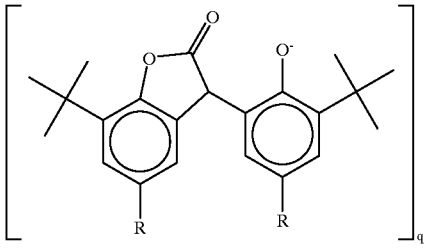

or

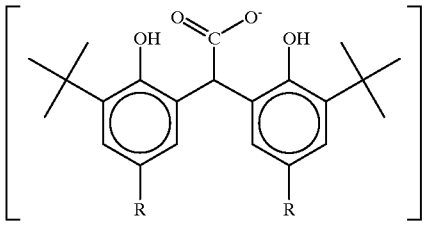

Here $M^{+n}$ is a metal ion having a charge n, q is a number form 1 to n, the valence of the metal ion being wholly or partially satisfied by the anion, and each R is independently an alkyl group containing preferably 8 to 150 carbon atoms. Two structures are presented, since the exact form of the salt is not definitively known, as described below. For purposes of the present invention, however, the structures are considered to be generally equivalent.

Thus the expressions "represented by the structure" or "represented by," as used in this application, means that the material in question has the chemical structure as indicated or has a related and generally equivalent structure. Thus, for example, an anion "represented by" a structure which shows an ionized carboxylic group and non-ionized phenolic OH groups, as the above, could also, in part or in whole, consist of materials in which one or more of the phenolic OH groups are ionized. Tautomeric structures and positional isomeric structures are also included.

U.S. Pat. No. 2,933,520 (Bader) and U.S. Pat. No. 3,954,808 (Elliott et al) describe procedures for preparing intermediates via reaction of phenol and acid.

The intermediate product obtained from the reaction of the foregoing hydroxy aromatic compounds and carboxylic acids is then reacted with a metal containing reactant to form a salt. Suitable metal containing reactants have been enumerated hereinabove.

The above examples are intended to be illustrative of suitable reactants and are not intended, and should not be viewed as, an exhaustive listing thereof.

It will be appreciated that the reaction of reactants (a) and (b) will lead to a compound containing a group Z which may be —OH or $(OR^4)_bOH$ as described hereinabove except that when the product is a lactone, Z may be absent. Furthermore, a phenolic group containing product may be reacted with, for example, an epoxide, to generate —$(OR^4)$OH groups, either on the intermediate arising from reaction of (a) and (b) or of a salt thereof.

The intermediate arising from the reaction of (a) and (b) may be a carboxylic acid or a lactone, depending upon the nature of (a). In particular, it is believed that when (a) is a completely hindered (e.g., 2,6-disubstituted) hydroxy aromatic compound, the product from (a) and (b) is a carboxylic acid. When the hydroxy aromatic reactant (a) is less hindered, it is believed that a lactone is generated. Often, the intermediate arising from the reaction of (a) and (b) is believed to be a mixture comprising both lactone and carboxylic acid.

When the intermediate from (a) and (b) is further reacted with the metal-containing reactant, it is believed that generally a carboxylic acid salt is formed first. If an excess of metal reactant is used, an amount beyond that needed for formation of a carboxylic acid salt, further reaction is believed to take place at aromatic —OH groups. For further details on these salts and the proposed mechanism of their formation, attention is directed to U.S. Pat. No. 5,281,346.

The salts can also be overbased. Overbased materials are single phase, homogeneous, generally Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of greater than 1, preferably at least 1.1 or 1.3, more preferably at least 1.5, preferably up to 40, more preferably 20, and even more preferably 10. A preferred metal ratio is 2–6.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromo-phenol blue as an indicator. The overbased materials of the present invention generally have a total base number of at least 20, preferably 100, more preferably 200. The overbased material generally have a total base number up to 600, preferably 500, more preferably 400. The equivalents of overbased material is determined by the following equation: equivalent weight=(56,100/total base number). For instance, an overbased material with a total base number of 200 has an equivalent weight of 280.5 (eq. wt=56100/200).

The overbased materials are prepared by reacting an acidic material (typically an inorganic acid or lower carboxylic acid, preferably carbon dioxide) with a mixture comprising the above described reaction product (in lactone, acid, or salt form) a reaction medium comprising at least one inert, organic solvent (mineral oil, naphtha, toluene, xylene, etc.) for said acidic organic material, a stoichiometric excess of a metal base, and a promoter.

The metal compounds useful in making the overbased metal salts are generally the same basic materials which have been described above for the formation of the salts. Preferred metals include calcium, magnesium, and barium.

While overbased metal salts can be prepared by merely combining an appropriate amount of metal base and carboxylic acid substrate, the formation of useful overbased compositions is facilitated by the presence of an additional acidic material. The acidic material can be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc., preferably $CO_2$. When $CO_2$ is employed, the product is referred to as a carbonate overbased (or carbonated) material; when $SO_2$, sulfite overbased (or sulfited); when $SO_3$, sulfate overbased (or sulfated). When sulfite overbased materials are further treated with elemental sulfur or an alternative sulfur source, thiosulfate overbased materials can be prepared. When overbased materials are further reacted with a source of boron, such as boric acid or borates, borated overbased materials are prepared. Thus carbonate overbased materials can be reacted with boric acid to prepare a borated material.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic, phenolic, and ethylene glycol promoters, which are preferred. The alcoholic promoters include the alkanols of one to about twelve carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Patents specifically describing techniques for making basic salts of acids include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Attention is drawn to these patents for their disclosures in this regard as well as for their disclosure of specific suitable basic metal salts.

The overbased alkylene-linked phenol/carboxyphenol.

Another suitable material is an overbased alkylene-linked polyaromatic molecule, the aromatic moieties whereof comprise at least one hydrocarbyl-substituted phenol and at least one carboxy phenol. In this embodiment the acidic material can be seen as the condensation product of an alkyl phenol, a salicylic acid or its equivalent, and an aldehyde. More generally, this material comprises at least one alkylene-linked polyaromatic molecule, the aromatic moieties whereof comprise at least one hydrocarbyl-substituted phenol and at least one carboxy phenol, which acidic material is present as an anion represented by (VII)

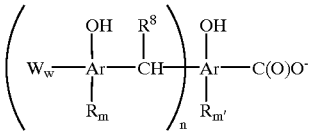

In this structure $R^8$ is hydrogen or an alkyl group of 1 to 6 carbon atoms, corresponding to the aldehyde from which it is derived (hydrogen, for formaldehyde, methyl for acetaldehyde, and so on. In this structure, each Ar is an aromatic group, as defined above, and R is likewise as has been defined above; typically in this context each R is independently an alkyl group containing 4 to 50 carbon atoms, preferably 7 to 30 carbon atoms, and more preferably 8 or 12 or even 15 to 24 carbon atoms. However, the total number of carbon atoms in the R groups of the molecule should be at least 7, preferably at least 14 or 16. Alternatively, in one embodiment R is an olefin polymer substituent. In the above structure n is 1 or 2 and m is 1, 2, or 3, and m' is 0, 1, or 2. In the above structure W represents (VIII)

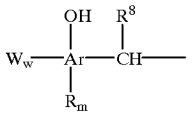

and each w (in the first and any subsequent W groups) is independently 0 or 1. That is to say, the structure can comprise more than two aromatic units linked by alkylene bridges. Generally the number of aromatic units thus linked will not exceed 4 or, preferably 3. In a preferred embodiment, w is 0.

In particular, when this component is the preferred condensate of an alkyl phenol, a salicylate, and formaldehyde, it will have a structure represented, in its ionic form by

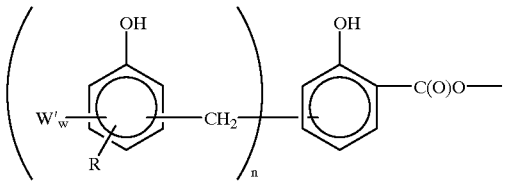

where W' is $W'_w(R)(OH)\Phi—CH_2—$ and Φ is a benzene ring.

This class of materials is prepared by reacting an alkylphenol with a salicylic acid and an aldehyde such as formaldehyde (or a reactive equivalent such as paraformaldehyde) under condensing conditions, followed by overbasing of the product. In general, this reaction can be conducted by mixing the phenol, the salicylic acid, and the aldehyde in an inert solvent, along with a small amount of base such as sodium hydroxide. The mixture is typically heated to a suitable temperature to effect the reaction, followed by removal of water to drive the condensation to completion. The mole ratios of the phenol and the salicylic acid is not particularly critical; typically 1:5 to 9:1 can be employed, more commonly 1:1 to 3: 1, preferably about 2:1. The amount of aldehyde is typically approximately 1 equivalent per mole of phenol, although slight excess (e.g., 30%, 20%, or 10%) is commonly employed to assure complete reaction of the phenol and the salicylic acid. The use of excess aldehyde can lead to further condensation reactions and higher molecular weight product, which can be desired under certain circumstances and are encompassed within the scope of the present invention. The reaction temperature for the condensation can be, for instance 80 to 150° C., preferably 100 to 130° C. Isolation of the adduct is by conventional means. Thereafter the adduct is overbased by techniques as described above.

Lubricants of the present invention will normally comprise an amount of the salts hereinabove described, sufficient to provide improved detergency, antioxidant properties, or other performance properties (compared to the same composition, absent the salt), in addition to other optional components, in a medium of an oil of lubricating viscosity. Characteristic amount of these salts are typically 0.1 to 15% by weight (on an oil-free basis) in a finally formulated lubricant, preferably 0.5 to 5%, and even more preferably 1 to 2% by weight. In a concentrate, the amount of these materials will be correspondingly increased.

As previously indicated, the metal salts of this invention are useful as additives in preparing lubricant compositions where they function to improve, for example, thermal stability, detergency, dispersancy, anti-rust, antioxidancy and the like. They are also useful as flow improvers and as pour point and cloud point depressants for hydrocarbon oils.

In addition to the materials described above, the use of other additives is contemplated. Thus, it is sometimes useful to incorporate, on an optional, as-needed basis, other known additives which include, but are not limited to, dispersants and detergents of the ash-producing or ashless type, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, lubricity agents, diluents or and solvents to improve handleability which may include alkyl and/or aryl hydrocarbons, and antifoam agents. These optional additives may be present in various amounts depending on the intended application for the final product or may be excluded therefrom. These and other additives are described in greater detail in U.S. Pat. No. 4,582,618 (column 14, line 52 through column 17, line 16, inclusive).

The components can be blended together in any suitable manner and then admixed, for example with a diluent to form a concentrate as discussed below, or with a lubricating oil, as discussed below. Alternatively, components can be admixed separately with such diluent or lubricating oil. The blending technique for mixing the components is not critical and can be effected using any standard technique, depending upon the specific nature of the materials employed. In general, blending can be accomplished at room temperature; however, blending can be facilitated by heating the components.

The additives and components of this invention can be added directly to the lubricant. Preferably, however, they are diluted with a substantially inert, normally liquid organic diluent such as mineral oil, naphtha, toluene or xylene, to form an additive concentrate. These concentrates usually contain from 10% to 90% by weight of the components used in the composition of this invention and may contain, in addition, one or more other additives known in the art as described hereinabove. The remainder of the concentrate is the substantially inert normally liquid diluent.

The lubricants described herein are particularly suited for lubricating ceramic engines, high temperature engines, and natural gas fueled engines. By the term "ceramic engines" is meant engines which contain at least one ceramic part which must be lubricated.

Ceramics can be generally described as inorganic solids prepared by the well-known process of sintering of inorganic powders. Inorganic powders in general can be metallic or non-metallic powders, but as used in the present invention they are normally non-metallic powders. Such powders may also be oxides or non-oxides of metallic or non-metallic elements. The inorganic powders may comprise inorganic compounds of one or more of the following metals or semi-metals: calcium, magnesium, barium, scandium, titanium, vanadium, chromium, manganese, iron, cobalt, nickel, copper, zinc, yttrium, niobium, molybdenum, ruthenium, rhodium, silver, cadmium, lanthanum, actinium, gold, rare earth elements including the lanthanide elements having atomic numbers from 57 to 71, inclusive, the element yttrium, atomic number 39, and silicon. The inorganic compounds include ferrites, titanates, nitrides, carbides, borides, fluorides, sulfides, hydroxides and oxides of the above elements. Specific examples of the oxide powders include, in addition to the oxides of the above-identified metals, compounds such as beryllium oxide, magnesium oxide, calcium oxide, strontium oxide, barium oxide, lanthanum oxide, gallium oxide, indium oxide, selenium oxide, etc. Specific examples of oxides containing more than one metal, generally called double oxides, include perovskite-type oxides such as $NaNbO_3$, $SrZrO_3$, $PbZrO_3$, $SrTiO_3$, $BaZrO_3$, $BaTiO_3$; spinel-type oxides such as $MgAl_2O_4$, $ZnAl_2O_4$, $CoAl_2O_4$, $NiAl_2O_4$, $NiCr_2O_4$, $FeCr_2O_4$, $MgFe_2O_4$, $ZnFe_2O_4$, etc.; illmenite-types oxides such as $MgTiO_3$, $MnTiO_3$, $FeTiO_3$, $CoTiO_3$, $ZnTiO_3$, $LiTaO_3$, etc.; and garnet-type oxides such as $Gd_3Ga_5O_{12}$ and rare earth-iron garnet represented by $Y_3Fe_5O_{12}$.

An example of non-oxide powders include carbides, nitrides, borides and sulfides of the elements described above. Specific examples of the carbides include SiC, TiC, WC, TaC, HfC, ZrC, AlC; examples of nitrides include $Si_3N_4$, AlN, BN and $Ti_3N_4$; and borides include $TiB_2$, $ZrB_2$ and $LaB_6$. The inorganic powders may also be a clay. Examples of clays include kaolinite, nacrite, dickite, montmorillonite, nontronite, spaponite, hectorite, etc.

In one embodiment, the inorganic powder is silicon nitride, silicon carbide, zirconia, including yttria-stabilized zirconia, alumina, aluminum nitride, barium ferrite, barium-strontium ferrite or copper oxide. In another embodiment, the inorganic powder is alumina or clay. Preferably the ceramic is prepared from alumina, aluminum nitride, silicon carbide, barium ferrite copper oxide, or most preferably silicon nitride ($Si_3N_4$).

Among the many parts in an engine which may be made of ceramic or coated with a ceramic layer are tappets, camshafts, rocker arms, connecting rods, oil pump gears, pistons, piston rings, piston pins, cylinder liners, cylinder heads and cylinder head faces, intake and exhaust port liners, bearings, turbocharger parts, and the interior of the combustion chamber. Such parts can be entirely made of ceramics, or they can be metal parts which have a ceramic coating or lining. In addition, fibers of aluminum oxide, silicon carbide, or other ceramic materials can be used to reinforce specific metal parts. The engines themselves can be uncooled, air cooled, or cooled with a fluid such as an oil.

The lubricant in the present invention will typically be supplied to the engine from a sump by means of a pump, as in a traditional sump-lubricated spark-ignited gasoline engine or a sump-lubricated diesel engine, although other means can be used (as in a two-cycle compression-ignited diesel engine).

A characteristic of certain ceramic engines, and particularly of low heat rejection ceramic engines, is the relatively high temperatures at which they can operate. High temperature operation can result in higher theoretical fuel economy, since less of the energy of the fuel is spent as exhaust heat. The insulating effect of the ceramic materials can reduce heat transfer from the exhaust gas to other parts of the engine, improving intake volumetric efficiency and waste heat recovery efficiency (which can be effected by a turbocharger stage). Furthermore, such engines may be able to operate on a wider variety of fuels than lower temperature engines. However, high temperature operation puts greater demands on the lubricant for such an engine. The present invention is particularly useful for lubricating engines, whether of ceramic or conventional construction, at temperatures of at least 250° C. preferably at least 300° C., or even up to 600° C. or higher. The temperature within an engine, of course, can vary greatly from location to location, but the temperatures referred to above are to be understood as measured within the cylinder wall at the top ring reversal (TRR) position. This location is the position of the greatest extent of travel of the uppermost piston ring in a compression or exhaust stroke.

Finally, the lubricants of the present invention are particularly useful for lubricating natural gas powered internal combustion engines. These engines are historically large, heavy duty, stationary engines either two-cycle or four-cycle, spark or compression ignited, designed to run at comparatively high temperatures on natural gas and other like fuels, such as sewer digester gas. Their lubricating needs are described in greater detail in "The Lubrication of Gas Engines," R. J. Gilbert and Wootton, D. B., in Gas Engines and Co-Generation: Papers Presented at a Seminar Organized by the Combustion Engines Group of the Institution of Mechanical Engineers and held at The National Motor Museum, Solihull, West Midlands, UK, May 10–11 1990. These engines are subject to corrosions, deposits, and wear, due in part to the diversity of contaminants present in the fuels.

The lubricants are employed in these engines in a conventional manner, that is, by supplying to the engine, or to the particular parts of the engine which require lubrication, a lubricant composition of the above defined lubricant composition. The engine is then operated in the usual manner.

The lubricants of the present invention are particularly suited for such engines because of their requirement for lubricant stability, as evidenced by anti-oxidation performance, particularly in synthetic ester lubricants.

Moreover, lubricant compositions in which the additive is a salt of the reaction product of (i) glyoxylic acid or a hydrocarbyl-substituted glyoxylic acid and (ii) certain hydroxyaromatic compounds containing at least two hydrocarbyl substituents, are useful for lubrication engines generally. For these preferred materials each of the hydrocarbyl groups in the hydroxyaromatic compounds have at least 4 carbon atoms, and at least a portion of the molecules thereof are substituted with an alkyl group of at least 8 carbon atoms. These hydroxyaromatic compounds further contain a tertiary alkyl group in a position ortho to the hydroxy group. Such materials can be represented by the structures

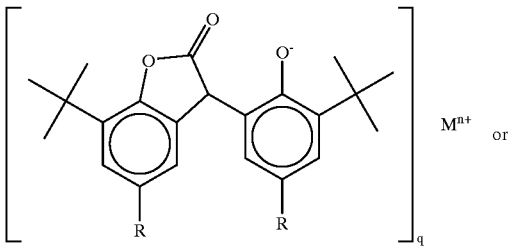

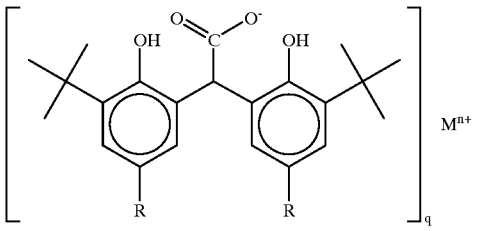

which have been described in detail above. Such materials are particularly useful because of their excellent anti-oxidation performance, particularly in synthetic ester lubricants, and their good detergency properties.

EXAMPLES

Example 1

To a 12-L 4-neck reactor with stirrer and a condenser with a Dean-Stark water trap and a nitrogen inlet and thermocouple is added 7196 g o-t-butyl, p-(propylene tetramer) phenol (22.5 moles), 1360 mL toluene, 1664.8 g glyoxylic acid (50%) and 7.6 g p-toluenesulfonic acid catalyst (93%). The mixture is heated with stirring under nitrogen to 96° C., whereupon removal of water from the trap is begun. Water, 1120 mL, is collected as the temperature is increased from 96 to 150° C.; toluene, 1100 mL is also removed. The reaction mixture is maintained at 150–151° C. for 2.5 hours, removing an additional 80 mL water and 115 mL toluene. The mixture is stripped at 152° C. for 2 hours; 52 g filter aid is added to the remaining material. The product is filtered through an additional 24 g filter aid to yield a bright red oil, 7237.4 g, as the filtrate.

Example 2

A 1-L, 4-necked round bottom flask is charged with 414.2 g of the material from Example 1, 81.5 g polyalphaolefin diluent oil, 17.8 g ethylene glycol. The mixture heated to 125° C., with stirring, under a subsurface nitrogen purge of 8 L/hr (0.3 std. $ft^3$/hr), and 50.3 g calcium hydroxide is charged. The mixture is heated with continued stirring to 145–150° C. for 45 minutes and maintained at that temperature while removing a 6.5 mL of water by distillation using a Dean-Stark trap over the course of 6.5 hours. The reactor is reconfigured for distillation and the mixture heated to 170° C. at 2.1 kPa (16 mm Hg) pressure, removing 4.5 mL organic and 5.5 mL aqueous distillate. The mixture is allowed to cool to 22° C., then reheated for filtration using 10.5 g filter aid, over 4.5 hours. The product is the filtrate, a reddish-brown liquid solidifying at 40° C. to a glass.

Example 3

A 5-L, 4-necked round bottom flask is charged with 1154 g of the material from Example 1, 1120.8 g diluent oil, 20 g ethylene glycol, 118.2 g commercial alkanesulfonic acid, and 80.4 g calcium hydroxide, under a subsurface nitrogen purge of 8 L/hr (0.3 std. $ft^3$/hr). The mixture is heated, with stirring, to 150° C. for 45 minutes (removing a small amount of water by distillation). The mixture is cooled to 145° C. and an additional 309.2 g calcium carbonate, 397 g ethylene glycol, and 488 g decyl alcohol are added. The mixture is reheated to 132° C. and addition of carbon dioxide at 28 L/hr (1.0 std. $ft^3$/hr) is begun. Addition of the carbon dioxide is continued for 2 hours; thereafter nitrogen is fed to the system. The temperature is increased to 190° C. over 43 minutes, during which time 192 mL water and 103 mL of a light organic layer are removed by distillation. The mixture is vacuum distilled at 200° C., the residual material cooled to 150° C. and filtered through a filter aid, obtaining 189 g product (containing about 40% diluent).

Example 4

A 1-L, 4-necked round bottom flask is charged with 414 g of the material from Example 1, 100 g diluent oil, 67 g xylene, 7 g tap water, 15.45 g magnesium oxide, and 13.7 g commercial alkanesulfonic acid, under a subsurface nitrogen purge of 5 L/hr (0.2 std. $ft^3$/hr). The mixture is heated, with moderate stirring, to 114° C. and maintained at reflux for 2.5 hours. The mixture is further heated to 160° C. for 3.0 hours, with removal of light solvent fraction by distillation. The mixture is cooled, ethylene glycol, 15 g, is added, stirred rapidly, and the mixture is heated to 160° C. for 4.0 hours. The mixture is cooled to 140° C. and pressure reduced to 13–3 k Pa (100–25 mm Hg) while heating again to 185° C. After removal of light solvent(s), the mixture is cooled to about 40° C. and acetic acid, 6.5 g, water, 18.5 g, methanol, 30 g, and toluene, 200 g, are added. The reaction mixture is heated to 70° C. for 10 hours, followed by stripping at 140° C. and 3 kPa (25 mm Hg). After addition of 199 g diluent oil and filtration through a filter aid, the product is obtained, containing about 40% diluent.

Example 5

To a 3-L, four-necked round bottom flask is added 790 g propylene tetramer-substituted phenol, 200 g diluent oil, 600 g xylenes, 222 g glyoxylic acid (50 weight percent. aqueous) and 4 g commercial alkanesulfonic acid as catalyst. The mixture is blown with nitrogen at 8 L/hr (0.3 std. $ft^3$/hr) and stirred, and heated to 160° C. for 3.5 hours, with removal of 156 mL water in a water trap. The mixture is returned to room temperature under static nitrogen, and 42 g water, 58 g methanol, and 126.6 g magnesium oxide are added. The mixture is heated to 60° C. for 3.5 hours. Carbon dioxide is blown into the system at 28 L/hr (1.0 std. $ft^3$/hr); after 1 hour the uptake of carbon dioxide slows. The flow of carbon dioxide is reduced to 8 L/hr (0.3 std. $ft^3$/hr) and the system is reconfigured for distillation. The mixture is heated to 160° C.; 500 mL distillate is removed, and in its place 454.3 g diluent oil is added. A filter aid, 58 g, is also added at this time, vacuum applied, 3.7 kPa (28 mm Hg) pressure, and an additional 35 g filter aid added. The mixture is maintained at 160° C. under vacuum for 0.5 hours. The mixture is cooled to 140° C. and filtered, at this temperature, over 2 days. The filtrate is the product.

Example 6

A 1-L, 4-necked round bottom flask is charged with 432 g of the material from Example 1, 100 g diluent oil, and 25.6 g 50% aqueous sodium hydroxide, under a subsurface nitrogen purge of 14 L/hr (0.5 std. $ft^3$ /hr). The mixture is heated, with stirring, to 60° C. and a second portion of 25.4 g aqueous sodium hydroxide is added. The mixture is heated to about 110° C., at which point water begins to be removed. The composition is heated to 160° C. and maintained for 1 hour for further removal of water. The mixture is cooled to 100° C., 204.9 g diluent oil is added. The resulting product contains about 40° C. diluent oil.

Example 7

To a 5-L flask is added 1515 g o-t-butyl-p-(propylene tetramer)phenol, 485 g toluene, and 421.8 g 50% aqueous glyoxylic acid. The flask is placed under nitrogen at 8L/hr (0.3 std. ft3 /hr), stirred, and heated to reflux to remove water. The mixture is heated to 150° C. and maintained at temperature for 3.6 hours, thereafter cooled overnight and reheated to 130° C. at a pressure of 1.3 kPa (10 mm Hg), removing a distillate. A mixture of 9% calcium hydroxide in 91% filter aid is prepared, and 22 g is added to the reaction mixture in the flask. The stirred reaction is maintained at 150° C. for 15 minutes, then cooled to 120° C. and filtered through a glass cloth fiber pad to give 1569 g of a viscous red oil as the product.

Example 8

To a 4-necked, 3-L round bottom flask is added 288.5 g of product prepared as in Example 1, 280.2 g diluent oil, 9.5 g ethylene glycol, 30 g commercial alkanesulfonic acid, and 20.1 g calcium hydroxide. The mixture is heated, with stirring under nitrogen (8L/hr (0.3 std. $ft^3$/hr)). The mixture is held at 150° C. for 1 hour, removing 2.2 mL water. The mixture is cooled to 140° C., while 95 g ethylene glycol, 122 g decyl alcohol, and an additional 77.3 g calcium hydroxide are added. The mixture is heated to 139° C. and $CO_2$ is introduced into the reaction while the temperature is increased to 150° C. over 10 minutes. Flow of $CO_2$ is maintained at 28 L/hr (1.0 std. $ft^3$/hr) for an additional 21 minutes. Flow of $CO_2$ is discontinued, replaced with nitrogen. The temperature is increased to 190° C. over 30 minutes, removing a total of 46 mL aqueous layer and 28 mL organic layer. The mixture is vacuum stripped at 200° C. at 2.4+/−0.9 kPa(18+/−7 mm Hg) for 2.0 hours. The material is cooled to 150° C., then cooled to 150° C. and filtered through filter aid to give 652.2 g oil as product.

Example 9

A mixture is prepared by combining 3317 parts of a polybutene-substituted phenol prepared by boron trifluoride-phenol catalyzed alkylation of phenol with a polybutene having a number average molecular weight of approximately 1,000 (vapor phase osmometry), 218 parts 50% aqueous glyoxylic acid (Aldrich Chemical) and 1.67 parts 70% aqueous methanesulfonic acid in a reactor equipped with a stirrer, thermo-well, subsurface gas inlet gas inlet and a Dean-Stark trap with condenser for water removal. The mixture is heated under a nitrogen flow to a temperature of 160° C. over one hour. The reaction is held at 160° C. for four hours with removal of water; a total of 146 parts aqueous distillate is collected. Mineral oil diluent, 2284 parts, is added with stirring followed by cooling of the reaction mixture to room temperature. At room temperature, 117.6 parts 50% aqueous sodium hydroxide and 500 parts water are added with stirring followed by exothermic reaction to about 40° C. over 10 minutes. The Dean-Stark trap is removed and the condenser is arranged to allow for reflux. The mixture is heated over one hour to a temperature of 95° C. and is held at this temperature for three hours. The reaction mixture is then cooled to about 60° C. and stripping is started by applying a vacuum to reduce the pressure to about 13 kPa (100 millimeters mercury). The pressure is slowly decreased and the temperature is increased over a period of approximately eight hours until the temperature is 95° C. and the pressure is 20 millimeters mercury. The reaction is then held at this temperature and pressure for three hours to complete stripping. The residue is filtered through a diatomaceous earth filter aid at a temperature of about 95° C. The resulting product, containing approximately 40% mineral oil diluent has a sodium content of 0.58%, ASTM color (D1500) of 7.0 (neat), and a total base number of 13.2. The infra-red spectrum of the product is substantially free of absorption at 1790 $cm^{-1}$ indicating absence of lactone carbonyl.

Example 10

A reactor is charged with 3537 parts of a propylene tetramer-substituted phenol prepared by alkylation of phenol with a propylene tetramer in the presence of a sulfonated polystyrene catalyst (marketed as Amberlyst-15 by Rohm & Haas Company), 999 parts of 50% aqueous glyoxylic acid (Hoechst Celanese) and 3.8 parts 70% aqueous methane sulfonic acid. The reaction is heated to 160° C. over three hours under a nitrogen flow. The reaction is held at 160° C. for four hours while collecting 680 parts water in a Dean-Stark trap.

A mineral oil diluent, 2710 parts, is added in one portion with stirring and the reaction is cooled to room temperature. At room temperature, 540 parts 50% aqueous sodium hydroxide and 1089 parts water are added quickly with stirring followed by an exothermic reaction to about 54° C. over ten minutes. The Dean-Stark trap is removed and the condenser is arranged to allow for reflux. The reaction mixture is heated to 95–100° C. and held at this temperature range for three hours. The mixture is then cooled to 60° C. and a vacuum is applied until the pressure reaches 13 kPa (100 millimeters mercury). Vacuum stripping of water is begun while the temperature is slowly increased to 95–100° C. over seven hours while reducing pressure to 20 millimeters mercury. Stripping is continued at 95–100° C. at 20 millimeters mercury pressure for three hours. The residue is filtered through a diatomaceous earth filter aid at 90–100° C. A product containing approximately 40% diluent oil is obtained containing, by analysis, 2.18% sodium and which has an ASTM color (D-1500) of 6.5. The infra-red spectrum shows no significant absorption at 1790 $cm^{-1}$ indicating the product contains no lactone carbonyl.

Example 11

A mixture of 681 parts of a polyisobutene substituted phenol-glyoxylic acid reaction product prepared according to the procedure of Example 9, 11 parts calcium hydroxide, 461 parts of mineral oil and 150 parts of water are charged to a reactor and heated under a nitrogen blanket at 100–105° C. for four hours. The reaction mixture is stripped at 115–120° C. at 66 Pa (five millimeters mercury) pressure over four hours. The residue is filtered at 115–120° C. employing a diatomaceous earth filter aid. The filtered product containing approximately 40% diluent oil contains, by analysis, 0.42% calcium and has a total base number of 15.1. The infra-red spectrum of the product shows a weak absorption at 1778 $cm^{-1}$ indicating a trace of lactone in the product.

Example 12

A reactor is charged with 655 parts of a propylene tetramer-substituted phenol prepared according to the procedure given in Example 8, 185 parts 50% aqueous glyoxylic acid (Aldrich) and 0.79 parts 70% aqueous methanesulfonic acid. The flask is equipped with a subsurface nitrogen inlet, a stirrer, thermowell and Dean-Stark trap for the collection of water. The materials are heated to 120° C. over three hours. 119 parts water is collected (theory=137.5 parts). Mineral oil diluent (490 parts) is added in one increment followed by cooling to 60° C. At 60° C., 52.5 parts lithium hydroxide monohydrate is added. No exothermic reaction is noted. The reaction mixture is heated to 95° C. for one hour. At this point the infra-red shows substantially no lactone absorption. Heating at 95° C. is continued for an additional two hours, followed by vacuum stripping to 95° C. at 3.3 kPa (25 millimeters mercury) for three hours. The residue is filtered through diatomaceous earth filter aid. The dark orange liquid contains 5.02% sulfate ash which indicates 0.63% lithium content. The product has a total base number of 59.

Example 13

A reactor is charged with 2500 parts of a propylene tetramer-substituted phenol prepared according to the procedure given in Example 8, 706 parts 50% aqueous glyoxylic acid (Aldrich) and 4.75 parts paratoluene sulfonic acid monohydrate (Eastman) and 650 parts toluene. The materials are heated under nitrogen at reflux (maximum temperature 140° C.) for 10 hours; 490 parts water is collected using a Dean-Stark trap. The reaction product is stripped to 130° C. at 20 millimeters mercury pressure over three hours.

Mineral oil diluent (1261 parts) is added and the product is filtered through diatomaceous earth filter aid at 100° C. The infra-red spectrum shows an absorbance at 1795 $cm^{-1}$ indicating the presence of lactone. Another reactor is charged with 500 parts of this lactone-containing product, 48.4 parts 50% aqueous sodium hydroxide, 100 parts water and 83 parts mineral oil diluent. The materials are reacted under nitrogen at 95–100° C. for ten hours. The reaction mixture is vacuum stripped to 120° C. at 2.7 kPa (20 millimeters mercury) pressure over three hours. The residue is filtered through a diatomaceous earth filter aid at 100–120° C. The filtered product shows 2.36% sodium, by analysis. The infra-red spectrum shows no lactone carbonyl absorption at 1795 $cm^{-1}$.

Example 14

A reactor is charged with 528 parts of a propylene-tetramer substituted phenol-glyoxylic acid reaction product prepared in the same manner described in Example 10, 18.5 parts sodium hydroxide, about 433 parts toluene and 40 parts water. The materials are heated under nitrogen at 85° C. (reflux) for four hours. Barium chloride dihydrate (Eastman) (56 parts) is added and the materials are heated at reflux for four hours followed by removal of water employing a Dean-Stark trap over three hours. The materials are cooled and solids are removed by filtration. The filtrate is stripped to 150° C. at 2.0 kPa (15 millimeters mercury) pressure. The residue contains, by analysis, 2.82% barium and 1.01% sodium. The infra-red spectrum shows a weak lactone absorption.

Example 15

A reactor is charged with 420 parts of a propylene-tetramer substituted phenol-glyoxylic acid reaction product prepared according to the procedure given in Example 10, 31 parts potassium hydroxide and about 260 parts toluene. The materials are heated under nitrogen to 120° C. and held at 120–130° C. for four hours. Following reaction, the infra-red spectrum shows no lactone remains. Naphthenic oil diluent (660 parts) is added followed by stripping to 140° C. at 270 Pa (2 millimeters mercury) pressure for three hours. The residue is filtered through a diatomaceous earth filtrate at 130–140° C. The filtrate contains, by analysis, 1.47% potassium and has a total base number of 21.6.

Example 16

(a) 3537 g of tetrapropylene-substituted phenol, 999 g glyoxylic acid, and 3.8 g methanesulfonic acid, are charged to a 12 L 4-necked flask equipped with a stirrer, thermowell, subsurface gas inlet, and Dean-Stark trap with condenser for water removal. The reaction mixture is heated to a final temperature of 160° C. over 3 hours under a nitrogen flow rate of 14 L/hr (0.5 std. $ft^3$/hr). The mixture is maintained at 160° C. for 4 hours, with removal of water. Diluent oil, 2910 g, is added in one portion and the reaction mixture cooled to 25° C. to stand overnight.

(b) Thereafter 540 g of 50% aqueous sodium hydroxide and 1089 g water are added to the mixture in one portion. After an initial exotherm, the reaction is heated to 95–100° C. and maintained for 3 hours. After cooling the reaction mixture to 60° C., a vacuum of 13.3 kPa (100 mm Hg) pressure is applied and vacuum stripping of water is begun. The temperature is slowly increased to 95–100° C. over 7 hours while the pressure is reduced to 2.7 kPa (20 mm Hg). The mixture is maintained at this temperature and pressure for 3 hours. The reaction product is filtered through a filter aid at 90–100° C.

(c) Into a 3-L flask equipped with stirrer, thermowell, subsurface inlet tube, and cold water condenser are charged 1293 g of material from part (b) above and the material heated to 93° C. Diluent oil, 70 g, is added, followed by a solution of 71.5 g $CaCl_2$ in 84 g water, and the mixture is stirred for 15 minutes. A charge of 67 g $Ca(OH)_2$ is added and mixed for 15 minutes at 90–50° C., followed by heating to 150° C. to dry and cooling to room temperature. The mixture is reheated to 50° C. and 130 g methanol is added. Carbon dioxide is introduced into the mixture at 14 L/hr (0.5 std. $ft^3$/hr) for about 75 minutes. The mixture is heated to 100° C. to strip for 30 minutes under a nitrogen flow of 28L/hr (1.0 std. $ft^3$/hr). Thereafter the product is filtered using a filter aid.

For additional examples of preparation of hydrocarbyl-substituted carboxyalkylene-linked phenols of this type and their neutral salts, attention is directed to PCT publication WO 93/21143, particularly pages 32 to 38.

Neutral metal salts are employed in fully formulated lubricant samples, which contain, in addition to the subject salt, about 1.2 % C9 mono- and di-para alkylated diphenylamine. The amount of salt is adjusted in each case to provide the same amount of ash (sulfated ash test) for each sample. The formulations are subjected to a high temperature panel Coker deposit test. This test involves, first, pre-stressing the oil on an aluminum oxidation block to simulate aging. The pre-stressing includes heating a sample to which is added 50 parts per million iron salt, for 24 hours at 220° C. under an air flow of 50 mL/min. The pre-stressed oil is then subjected to a modified high temperature panel Coker deposit test, involving four hours of repeated cycling between 310° C. and 100° C. The results are analyzed in terms of carbon deposits and varnish deposits on the test panel, and rated on a scale of "none" to "heavy."

| Ex. | Additive, % | Base fluid | Carbon | Varnish |
|---|---|---|---|---|
| 17 | neutral Ca salt of dodecylphenol/glyoxylic acid additive, 12.5% | 100 N diluent oil | light | heavy |
| 18[x] | same as 17 | B | light; light | light; very light |
| 19[x] | same as 17 | C | light; none; light | light; medium; light-med. |
| 20 | same as 17 | D | light | light |
| 21 | neutral Na salt of dodecylphenol/glyoxylic acid additive, 12.6% | C | very light | very light |
| 22 | same as 21 | D | light | medium |
| 23 | same as 21 | A | light | light |
| 24 | neutral Li salt of dodecylphenol/glyoxylic acid additive, 17.1% | C | none | light |
| 25 | same as 24 | D | light | medium |
| 26 | same as 24 | A | heavy | heavy |
| 27 | neutral K salt of polyisobutenyl($M_n$940)phenol/glyoxylic acid additive, 22.3% | D | none | light-medium |
| 28 | overbased, carbonated Ca salt of dodecylphenol/glyoxylic acid additive, as from Ex. 16, 8.1% | A | medium | medium |
| 29 | same as 28 | 100 N diluent oil | heavy | heavy |
| 30 | same as 28 | B | light | light |

-continued

| Ex. | Additive, % | Base fluid | Carbon | Varnish |
|---|---|---|---|---|
| 31 | Ca salt of t-butyl material, as in Ex. 3, 10.1% | A | medium | heavy |

[x]Multiple runs
A Hercolube F ™; synthetic ester of pentaerythritol
B an experimental synthetic polyol ester
C an experimental synthetic polyol ester
D an experimental synthetic polyol ester It is observed that under the severe conditions of the above-described the superiority of synthetic lubricants over the less stable mineral diluent oil becomes apparent. The claimed salts exhibit good properties in a variety of media, especially certain synthetic ester lubricants. Some combinations of the claimed salts and specific esters, to be sure, will give superior results compared with other combinations. It is noted that certain of the salts exhibit little or no solubility in certain of the esters; it is believed that this may be the source of the increased deposits or varnish in certain combinations (e.g., Ex. 28). Accordingly, it is preferred that salt species be selected which are soluble in the base oil at the temperature of use. Moreover, although the t-butyl substituted materials may likewise not provide superior results in every formulation in a high temperature deposit test, they do exhibit good antioxidant activity, as shown in the following example:

Example 32

A mixture is prepared of 8 weight percent calcium overbased propylene tetramer-substituted phenol (reacted with sulfur dichloride) (45% active material, in polyalpha olefin medium), 2 weight percent of an alkyl-substituted aryl amine inhibitor, and 2 weight percent of a calcium salt prepared in a manner similar to that of Example 3 (containing 0.68 moles $Ca(OH)_2$ per 0.60 moles phenol condensation product) in Hercolube F™ synthetic ester. The mixture is subjected to the catalytic micro-oxidation screen test, developed by Caterpillar Company. The test involves placing samples of a candidate crankcase oil on several metal coupons, heating the coupons in a cell of an aluminum block, removing the coupons at 10 minute intervals, and measuring the percent oil deposit (by weight) adhering to the disk. The results are reported as an induction time, which is determined from the time at which the amount of deposits dramatically increases. The composition of the present example exhibits an induction time of 119 minutes.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A process for lubricating an internal combustion engine which contains at least one ceramic part which requires lubrication, which operates at a temperature of at least 250° C. at the top ring reversal position, or which is powered by natural gas, comprising supplying to such an engine a lubricant composition comprising:

(a) a major amount of an oil of lubricating viscosity, and (b) a minor amount of a salt of an alkylene-linked polyaromatic molecule, the aromatic moieties of which comprise at least one hydrocarbyl-substituted phenol and at least one carboxy phenol, said salt being soluble in the oil of lubricating viscosity at the operating temperature of the engine.

2. The process of claim 1, wherein the anion portion of the salt is represented by

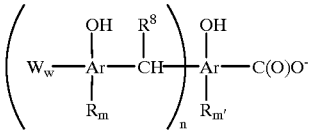

wherein $R^8$ is hydrogen or an alkyl group of 1 to about 6 carbon atoms, each Ar is an aromatic group, each R is a hydrocarbyl group containing at least about 4 carbon atoms, n is 1 or 2, m is 1, 2, or 3, m' is 0, 1, or 2, W represents

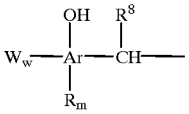

and each w is independently 0 or 1.

* * * * *